US007210196B2

(12) United States Patent
Shanor et al.

(10) Patent No.: US 7,210,196 B2
(45) Date of Patent: May 1, 2007

(54) BAGLESS VACUUM CLEANER AND DIRT COLLECTION ASSEMBLY

(75) Inventors: Michael J. Shanor, Nicholasville, KY (US); Alan T. Pullins, Lexington, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 312 days.

(21) Appl. No.: 10/929,642

(22) Filed: Aug. 30, 2004

(65) Prior Publication Data

US 2005/0044657 A1 Mar. 3, 2005

Related U.S. Application Data

(60) Provisional application No. 60/499,131, filed on Aug. 29, 2003.

(51) Int. Cl.
*A47L 9/12* (2006.01)
*A47L 9/10* (2006.01)

(52) U.S. Cl. ..... 15/353; 15/351

(58) Field of Classification Search ..... 55/487, 55/DIG. 3, 320, 323, 462, 465, 486; 15/327.1, 15/327.2, 327.3, 327.4, 327.5, 327.6, 327.7, 15/347, 350–353
See application file for complete search history.

(56) References Cited

U.S. PATENT DOCUMENTS 1,230,784 A * 6/1917 Rice ..... 55/462
1,230,827 A * 6/1917 Duffie ..... 15/351
1,762,142 A * 6/1930 Breton ..... 15/320
1,847,233 A 3/1932 Bilde
2,346,339 A * 4/1944 Vose ..... 15/344
3,959,844 A * 6/1976 Cyphert ..... 15/320
6,003,196 A 12/1999 Wright et al.
6,026,540 A 2/2000 Wright et al.
6,070,291 A 6/2000 Bair et al.
6,243,912 B1 * 6/2001 Grey ..... 15/320
6,260,234 B1 7/2001 Wright et al.
6,341,404 B1 1/2002 Salo et al.
6,353,963 B1 3/2002 Bair et al.
6,401,295 B2 6/2002 Bair et al.
6,428,589 B1 8/2002 Bair et al.
6,436,160 B1 8/2002 Stephens et al.
6,463,622 B2 10/2002 Wright et al.
6,546,592 B1 * 4/2003 Cockburn et al. ..... 15/344
6,588,054 B2 7/2003 Bair et al.
6,591,446 B2 7/2003 Bair et al.
6,735,815 B2 5/2004 Bair et al.
6,735,817 B2 5/2004 Bair et al.
6,745,432 B2 6/2004 Wright et al.

FOREIGN PATENT DOCUMENTS

JP 52-20669 * 2/1977
JP 56-136642 10/1981
JP 56-136650 10/1981

* cited by examiner

*Primary Examiner*—Terrence R. Till
(74) *Attorney, Agent, or Firm*—King & Schickli, PLLC

(57) ABSTRACT

A vacuum cleaner includes a housing, a suction generator and a dirt collection assembly. The dirt collection assembly includes an inlet, an outlet and a concave air deflector. Air is delivered into a dirt collection chamber formed in the dirt collection assembly along a substantially parabolic trajectory.

10 Claims, 3 Drawing Sheets

BAGLESS VACUUM CLEANER AND DIRT COLLECTION ASSEMBLY

This application claims the benefit of U.S. Provisional Patent Application Ser. No. 60/499,131 filed on Aug. 29, 2003.

TECHNICAL FIELD

The present invention relates generally to the floor care equipment field and, more particularly, to an upright or canister vacuum cleaner equipped with a dirt collection assembly and such a novel dirt collection assembly.

BACKGROUND OF THE INVENTION

Bagless vacuum cleaner technology has long been known in the art. Japanese Patent Applications 56-136642 and 56-136650, both published in 1981, disclose an upright vacuum cleaner with a dust collection chamber that removably connects to an opening of the main unit to facilitate user convenience during the emptying of the cleaner. A removable filter fills an opening at the bottom of the dust chamber and serves to separate dust from air drawn through the vacuum cleaner by the fan and motor assembly.

The present invention relates to an improved dirt collection assembly for an upright or canister vacuum cleaner.

SUMMARY OF THE INVENTION

In accordance with the purposes of the present invention as described herein, a vacuum cleaner includes a housing, a suction generator and a dirt collection assembly. The dirt collection assembly includes an inlet, an outlet and a concave air deflector.

More specifically describing the invention, the dirt collection assembly includes a dirt cup having a sidewall and a bottom wall. The inlet is provided in the bottom wall. Further the dirt cup has an open top forming the outlet. A filter chamber is provided on the downstream side of the dirt cup and prefilter. An optional filter may be provided in the filter chamber. Additionally, the vacuum cleaner may also include a rotary agitator held in the housing.

In accordance with yet another aspect of the present invention, a dirt collection assembly is provided. That dirt collection assembly comprises a dirt cup having a sidewall and a bottom wall, an inlet in the dirt cup, an outlet in the dirt cup and a concave air deflector. The inlet is provided in the bottom wall of the dirt cup. Additionally, a feed conduit extends from the inlet into the dirt cup. The concave air deflector is carried by the feed conduit.

The dirt collection assembly may further include a prefilter covering the outlet. In addition, the dirt collection assembly may include a filter chamber and a filter in the filter chamber. Both of these structures are optional but when provided the prefilter is positioned between the dirt cup outlet and the filter chamber. Typically the concave air deflector has a radius of curvature of between about 50 and about 100 mm.

In accordance with still another aspect of the present invention a method is provided for delivering air into a dirt collection vessel. The method comprises delivering that air into a dirt collection chamber formed in a dirt collection vessel along a substantially parabolic trajectory. This is done by deflecting the air off of a concave air deflector.

In the following description there is shown and described a preferred embodiment of this invention simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING FIGURES

The accompanying drawing incorporated in and forming a part of this specification, illustrates several aspects of the present invention, and together with the description serves to explain certain principles of the invention. In the drawing.

Reference will now be made in detail to the present preferred embodiment of the invention, an example of which is illustrated in the accompanying drawing.

DETAILED DESCRIPTION OF THE INVENTION

Figure 1:
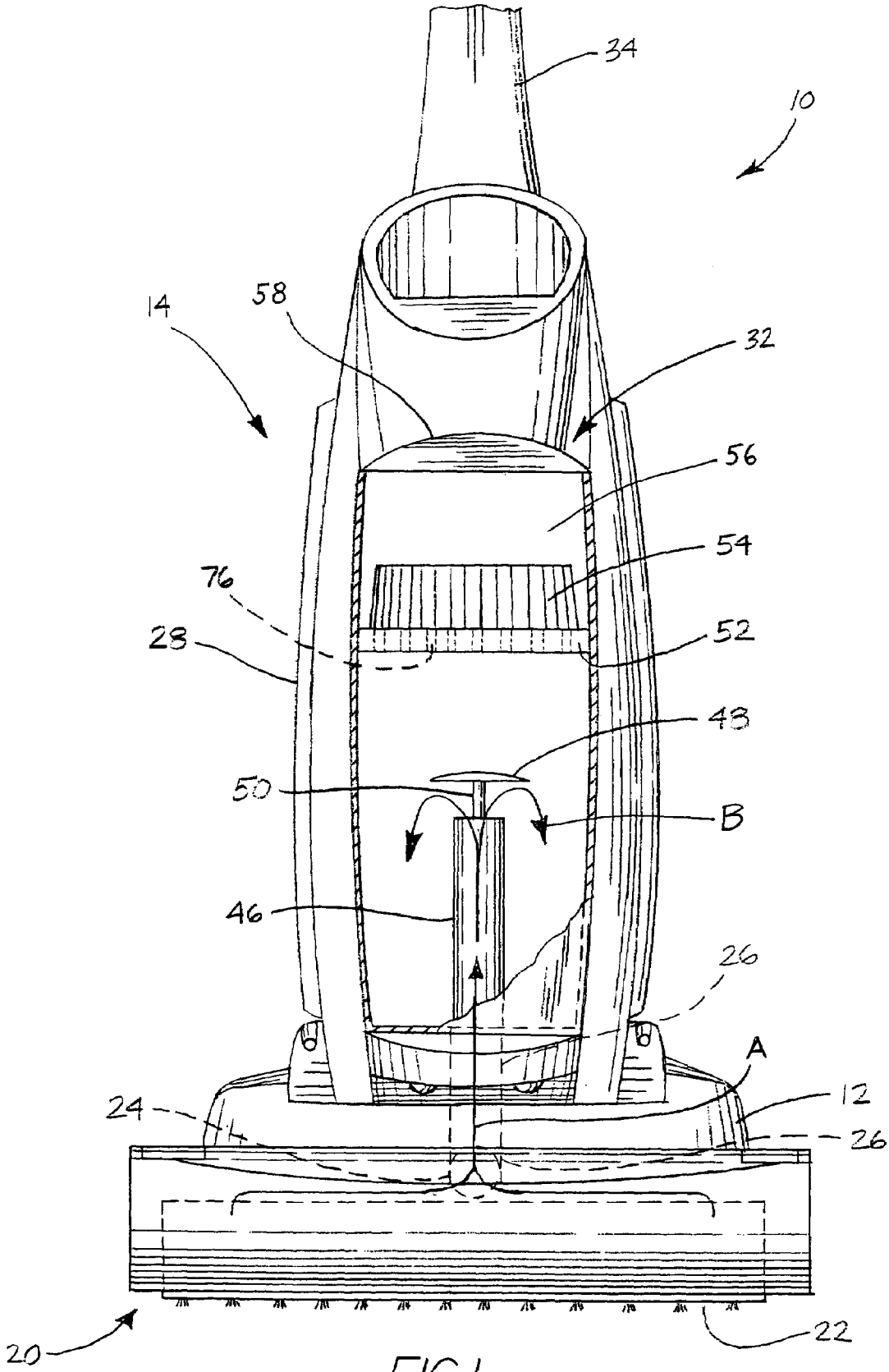
FIG. 1 is a schematical, elevational view illustrating a vacuum cleaner incorporating the novel dirt collection assembly of the present invention.

The vacuum cleaner 10 generally comprises a housing including a nozzle assembly 12 and a canister assembly 14. In the upright vacuum cleaner illustrated in FIGS. 1 and 2, the canister assembly 14 is pivotally connected to the nozzle assembly 12. Of course, in a canister vacuum cleaner the nozzle assembly 12 would be connected to the canister assembly 14 through a wand assembly including a wand and a flexible hose.

The nozzle assembly 12 and canister assembly 14 of the upright vacuum cleaner 10 include a pair of rear wheels 16 and a pair of height adjustable front wheels 18 for supporting the weight of the vacuum cleaner. Additionally, the nozzle assembly 12 includes an agitator cavity 20 that receives a rotary agitator 22. An intake port 24 is provided in the back of the agitator cavity 20. The intake port 24 is in fluid communication with a suction conduit 26 that extends at least partially through both the nozzle assembly 12 and the canister assembly 14. The canister assembly 14 includes a housing 28 including a cavity 30 for receiving and holding a dirt collection assembly generally designated by reference numeral 32. A control handle 34 is also connected to the housing 28 of the nozzle assembly 14.

The dirt collection assembly 32 includes a dirt cup 36 including a side wall 38 and a bottom wall 40 that define a dirt collection chamber 42. An inlet 44 is provided in the bottom wall 40. A feed conduit 46 is in fluid communication with the inlet 44 and extends at least partially into the dirt collection chamber 42. An air deflector 48 is mounted on the feed conduit 46 adjacent the open end 47 thereof by means of a bracket 50. As illustrated, the deflector 48 has a concave configuration with a concavity directed toward the open end of the feed conduit 46.

Typically, the concave air deflector 48 has a radius of curvature of between about 50 and about 100 mm and still more typically 75 and about 100 mm. It should also be appreciated that the dirt collection chamber 42 formed in the dirt cup 36 is typically cylindrical in shape. Further, both the feed conduit 46 and the air deflector 48 are concentrically positioned in the dirt collection chamber 42.

A prefilter 52, in the form of a mesh or screen, is received over or in and encloses the open top of the dirt cup 38. A filter 54, such as a filter cartridge with a pleated filter media is held in a cavity 56 formed in the filter chamber housing 58. A discharge outlet 60 in the filter chamber housing 58 is provided in fluid communication with a discharge conduit 62 formed in the rear of the canister assembly 14. The discharge conduit 62 has an outlet 64 in fluid communication with the internal chamber 66 in the canister assembly 14 that houses the suction generator 68 comprising a fan and motor assembly. As illustrated, the internal chamber 66 is divided by a partition 70 into an inlet chamber 72 and an exhaust chamber 74. The suction generator 68 bridges this partition 70.

In operation, the rotary agitator 22 beats and brushes dirt and debris from the nap of an underlying carpet being cleaned. That dirt and debris becomes entrained in a suction airstream drawn into the intake port 24 by operation of the suction generator 68 (see action arrow A in FIG. 1). The airstream, entrained with dirt and debris is then drawn from the suction conduit 26 through the inlet 44 and into the feed conduit 46 (note action arrows B in FIGS. 1 and 2). Next, the airstream with entrained dirt and debris is drawn through the open end of the feed conduit 46 and is directed by the deflector 48 outwardly into the dirt collection chamber 36 of the dirt cup 38. As a result of the action of the deflector 48, the airstream is dispersed in a substantially parabolic trajectory or path similar in shape to that of an open umbrella. The relatively heavy dirt and debris collects in the bottom of the dirt collection chamber 36 while the airstream, now devoid of this larger and heavier material, is drawn by the suction generator 68 through the passages 76 in the prefilter 52 (note action arrows C). The airstream then passes through the filter 54 where any remaining fine dirt and debris is captured.

The now clean airstream is then drawn by the suction generator 68 from the filter chamber 56 through the outlet 60 into the discharge conduit 62 (note action arrow D). The airstream then passes from the outlet 64 and is drawn into the intake chamber 72 of the suction fan cavity 66 (note action arrow E). The airstream then passes over the motor of the suction generator 68 and advantageously provides cooling for the motor (note action arrow F). The airstream is then exhausted from the discharge chamber 74 of the suction generator cavity 66 through a final filter 78 and a group of exhaust ports 80 (note action arrow G).

Figure 2:
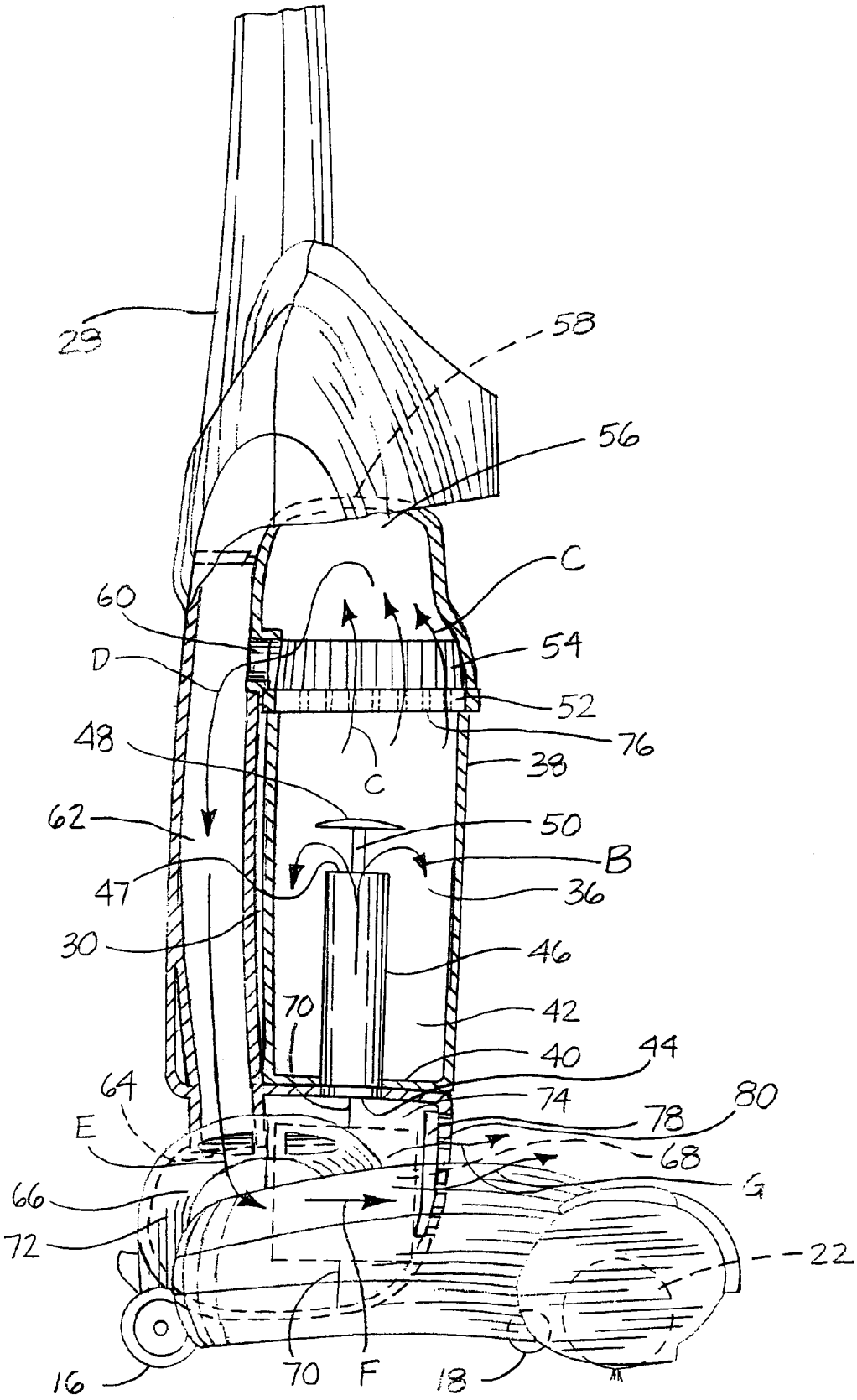
FIG. 2 is a schematical side elevational view of the vacuum cleaner shown in FIG. 1.
Figure 3:
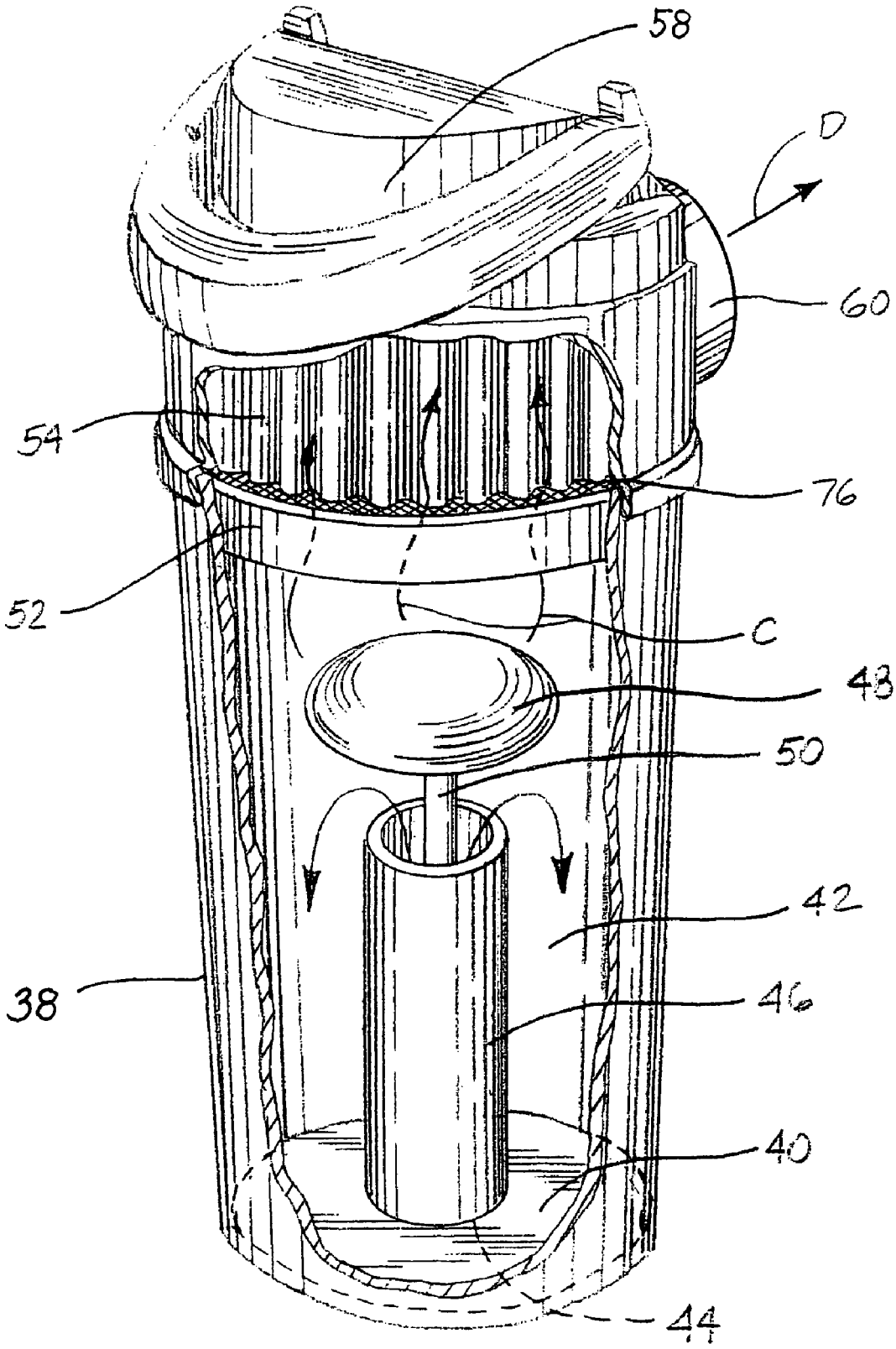
FIG. 3 is a partially cutaway, detailed perspective view of the dirt collection vessel.

The foregoing description of the preferred embodiment of this invention has been presented for purposes of illustration and description. It is not intended to be exhaustive or to limit the invention to the precise form disclosed. Obvious modifications or variations are possible in light of the above teachings. For example, in the illustrated embodiment the dirt cup 36 and the combined filter chamber 56 and prefilter 52 are separately removable from the housing 28 of the canister assembly. In an alternative embodiment, they all may be removed together. Further while a single agitator 22 is illustrated in FIG. 2, it should be appreciated that the vacuum cleaner may include multiple agitators. In addition, while a "clean air" system is illustrated with the suction generator 68 downstream from the dirt collection assembly 32, it should be appreciated that a "dirty air" system with the suction generator upstream from the dirt collection assembly is also contemplated. Further, while a dirt cup 38 is shown, a disposable bag could also be utilized in place of the dirt cup.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

What is claimed is:

1. A vacuum cleaner, comprising:

a housing;

a suction generator held in said housing; and a dirt collection assembly held in said housing, said dirt collection assembly including a dirt cup having a sidewall, a bottom wall, an inlet in said bottom wall, an outlet, a prefilter covering said outlet, a concave air deflector, a filter chamber and a filter in said filter chamber.

2. The vacuum cleaner of claim 1, wherein said dirt cup has an open top forming said outlet.

3. The vacuum cleaner of claim 1, wherein said prefilter is positioned between said dirt cup and said filter chamber.

4. The vacuum cleaner of claim 1, further including a rotary agitator held in said housing.

5. The vacuum cleaner of claim 1, wherein said concave air deflector has a radius of curvature of between about 50 and about 100 mm.

6. A dirt collection assembly, comprising:

a dirt cup having a sidewall and a bottom wall;

an inlet in said bottom wall of said dirt cup;

an outlet in said dirt cup;

a prefilter covering said outlet;

a concave air deflector;

a filter chamber; and a filter in said filter chamber.

7. The dirt collection assembly of claim 6, wherein a feed conduit extends from said inlet into said dirt cup.

8. The dirt collection assembly of claim 7, wherein said concave air deflector is carried by said feed conduit.

9. The dirt collection assembly of claim 6, wherein said prefilter is positioned between said outlet and said filter chamber.

10. The dirt collection assembly of claim 6 wherein said concave air deflector has a radius of curvature of between about 50 and about 100 mm.

* * * * *